United States Patent [19]

Wolfmüller

[11] Patent Number: 4,655,392

[45] Date of Patent: Apr. 7, 1987

[54] STEAM-GENERATOR CONTROL METHOD

[75] Inventor: Karlheinz Wolfmüller, Eppingen-Adelshofen, Fed. Rep. of Germany

[73] Assignee: Deutsche Forschungs- und Versuchsanstalt für Luft- und Raumfahrt e.V., Bonn, Fed. Rep. of Germany

[21] Appl. No.: 750,535

[22] Filed: Jun. 28, 1985

[30] Foreign Application Priority Data

Jul. 2, 1984 [DE] Fed. Rep. of Germany ..... 3424314

[51] Int. Cl.[4] ..... F23N 1/00; G05D 23/00

[52] U.S. Cl. ..... 236/15 E; 122/448 R; 431/12; 431/76

[58] Field of Search ..... 122/448 R, 448 S; 236/15 E; 431/12, 76; 110/185, 186

[56] References Cited

U.S. PATENT DOCUMENTS

| | | | |
|---|---|---|---|
| 3,243,116 | 3/1966 | Dijt et al. . | |
| 4,303,194 | 12/1981 | Kengle et al. | 236/15 E |
| 4,360,336 | 11/1982 | Shepherd | 236/15 E X |
| 4,516,929 | 5/1985 | Hiroi et al. | 236/15 E X |

FOREIGN PATENT DOCUMENTS

| | | |
|---|---|---|
| 3125513 | 1/1983 | Fed. Rep. of Germany . |
| 3221660 | 1/1983 | Fed. Rep. of Germany . |
| 2260751 | 2/1974 | France . |
| 2392327 | 5/1978 | France . |
| 2022263 | 5/1979 | United Kingdom . |

*Primary Examiner*—Edward G. Favors
*Attorney, Agent, or Firm*—Kenway & Jenney

[57] ABSTRACT

A steam-generator control method is proposed for controlling the mass flows of an oxidant and a fuel which are supplied for combustion. In order to control the flows at stoichiometric ratios with a required accuracy, the controlled variables are established by the measurements of the mass flows and their comparison with theoretically predetermined stoichiometric ratios. Measurement errors are defined continuously through a combustion-gas analysis, conducted by means of a probe after the combustion. The errors are used for the correction of the controlled variables. The time constant of the correction is smaller than the time constant of dynamic changes of the errors.

14 Claims, 3 Drawing Figures

STEAM-GENERATOR CONTROL METHOD

This invention relates to a steam-generator control method designed for controlling the mass flows of an oxidant and a fuel, which are supplied for combustion, at their stoichiometric ratios.

Modern power stations increasingly require an optimization of the combustion processes with regard to the stoichiometric reaction of oxidant and fuel in order to bring the amount of dangerous components of the exhaust gases to the lowest possible level. This applies, to a high degree, in the case of a so-called hydrogen/oxygen steam generator, a novel component of a power station. Such steam generators are suitable, in first place, as instant power reserve for conventional power stations and they are particularly useful for the equalizing of peak loads. In those steam-generators, hydrogen gas is burned in the presence of oxygen gas to produce water, and an extra amount of water is also supplied into the stream of hot gases. This results in the production of superheated steam corresponding to steam from conventional steam-generators. The hydrogen/oxygen process is not only aimed at optimum combustion parameters, but also at meeting additional safety requirements regarding the content of residual gases, because of the danger associated with the presence of residual oxygen or hydrogen in the superheated steam. Therefore, admissible limiting values have been defined to be 0.01% of hydrogen and 0.03% of oxygen in the steam.

No methods enabling such an exact control of the mass flows of combustion materials are known to date.

It is therefore an object of this invention to develop a control method enabling the control of the mass flows at virtually stoichiometric ratio.

According to the invention, a steam-generator control method is provided for controlling the stoichiometric ratio of the mass flows of an oxidant and a fuel supplied for combustion, in which the controlled variables are determined through the measurements of mass flows supplied and through their comparison with theoretically preset stoichiometric ratios. Measurement errors are continuously determined by means of a special probe through a combustion-gas analysis conducted upon the combustion. The errors are employed for the correction of the control variables, the correction taking place at a time constant that is shorter than the time constant of the dynamic changes of the errors.

The advantage of this solution is in the fact that, first of all, the controlled variables are determined on the basis of direct measurements of the mass flows supplied to combustion, so that a coarse preset value of the controlled variables can be attained very quickly via a direct regulation without a long control dead-time. In addition, the ratios of mass flows correspond approximately to the stoichiometric ratio values.

Direct measurements of this kind are, however, associated principally with an error that results essentially from variations of the thermodynamic variables of state of the oxidant and the fuel. This error is also subject to dynamic changes at the same time. Another advantage of the control system of the invention, then, is the fact that the error is determined, using the probe, through a subsequent analysis of the combustion gas and is used for the correction of the controlled variables within a time interval that is shorter than the time constant of the dynamic changes of the error.

As a result, the control method of the invention enables the systematic errors, occurring when the controlled variables are approximately at the preset value, to be corrected with sufficient speed, and, consequently, the mass flows to be controlled essentially at stoichiometric ratios. Further, the control method also enables, due to the continuous determination of errors, the accurate control of unsteady operating conditions, as, for example, in the case of a generator start-up.

There is no indication, in the above description of the control method of the invention, whether the mass flows should be measured in gaseous or in liquid phase. However, measurements in gas phase are provided in an embodiment of the invention.

It is possible to bring the controlled variables to the preset value very precisely on the basis of direct measurements; this is done when the measurements of the mass flows are conducted by a differential pressure method, so that extremely small follow-on corrections only are required subsequently. The differential pressure method should be preferred to other measurement methods, especially in the case of gases under a high absolute pressure. The differential pressure method makes it possible to obtain results with an error of ca. 1% subject to careful selection and design of the components of the measuring apparatus.

The probes or sampling devices used in the combustion-gas analysis generally impose definite requirements on the variables of state of the combustion gases to be tested. This means that an exact analysis of those gases is conditioned by a definite temperature and pressure. Hence, it is preferable that the combustion gases be taken for analysis at such a place in the steam generator where the values of the variables of state of the gases are suitable for the analysis by means of the probe, wherein the variables of state can still be changed without a supply of energy and within the conditions specified by the general gas equation of state (e.g. through expansion). The advantage of this feature is the elimination of an expensive processing (e.g. by heating or cooling) of the combustion gases to be tested. This processing, as a rule, has an adverse effect on the time constant in the determination of error through the probe analysis.

The pressure of the combustion gas in the steam generator usually exceeds the limit of application of the probe. The probe may be easily and simply accommodated, however, if the pressure of the combustion gases before reaching the probe is reduced to a level that is suitable for the operation of the probe. To do this, the combustion gases are sampled at a place in the steam-generator where their pressure and temperature are substantially higher then acceptable for the use of the probe, but both the pressure and temperature of the gas will decrease simultaneously, due to gas expansion, to the suitable level. The above-mentioned sampling point in the steam generator must be selected so that the temperature drop effected by the decrease in pressure is sufficient to bring the temperature to the operating level of the probe.

Various analytical methods can be employed for the analysis of the combustion gases in the probe: mass spectrometry, gas chromatography, optical methods, as well as measurements of thermal conductivity. However, an expensive preparation of the gases to be measured is necessary for all these methods, in order to meet the specific requirements of the measuring apparatus and thus to avoid method-related disturbances. Moreover, the time constants for a combustion-gas analysis are essentially in the order of minutes. Considering the drawbacks of prior art methods, it is preferable to conduct the combustion-gas analysis using a solid electrolyte probe.

In this respect, it is suggested that zirconium oxide ($ZrO_2$) be used as the solid electrolyte. Such a probe is superior to the prior art devices because of its sensitivity of response and, most importantly, its quick-action characteristics. The zirconium-oxide probe enables the analysis to be conducted within a time constant in the order of deciseconds (tenths of a second). Another advantage of the solid electrolyte probe is a drastic variation of its characteristic curve in the area of the stoichiometric point: i.e. at the change point between an excess of oxidant and an excess of unburned fuel. As a result, the values falling below or above the stoichiometric point can be detected simply and accurately.

In order to increase the long-term stability of the probe, it is preferable to operate the probe with atmospheric air as a reference gas.

Further features and advantages of the invention will be apparent both from the following description as well as the drawing presenting an embodiment of the method of the invention. The method is applied, by way of example, to a hydrogen/oxygen steam-generator.

In the drawings

Figure 1:
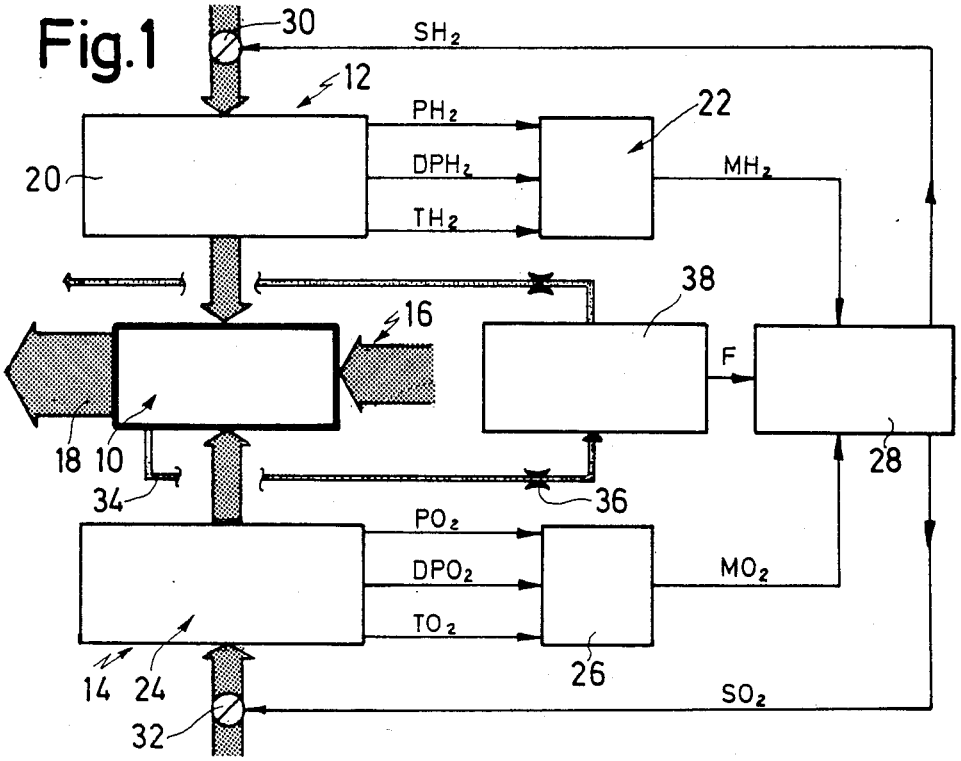
FIG. 1 is a block diagram of the control method

The block diagram shown in FIG. 1 represents a hydrogen/oxygen steam-generator for thermal conversion of hydrogen ($H_2$) and oxygen ($O_2$) into water ($H_2O$). The steam generating installation comprises a reaction chamber 10 in communication with a first hydrogen supply device 12 and a second oxygen supply device 14. A third water supply device 16, is also connected with the reaction chamber 10. Superheated steam is produced through the combustion of hydrogen with oxygen as oxidant, the combustion product being water, and through the subsequent supply of water to the resulting hot combustion gases. The superheated steam is carried off the reaction chamber 10 via a channel 18 and can be fed, for instance, to power plant turbines.

A measuring point 20 is provided in the first supply device 12 for the determination of hydrogen mass flow from the first supply device 12 into the reaction chamber 10. The mass flow is measured by a differential pressure method.

The differential pressure method is based on an orifice system installed in a supply line. It provides the measurements of an absolute pressure $PH_2$ before the orifice system, a differential pressure $DPH_2$ between the absolute pressure, and a pressure within the orifice system, and also the absolute temperature $TH_2$ of the hydrogen gas stream.

The hydrogen mass flow $MH_2$ that is directed from the first supply device 12 to the reaction chamber 10 can be defined from those three values $PH_2$, $DPH_2$ and $TH_2$ transmitted from the first measuring point 20 to a computer by means of a first computer program 22.

By analogy, the values $PO_2$, $DPO_2$ and $TO_2$ of the oxygen stream supplied to the reaction chamber 10 are determined at a second measuring point 24 by a differential pressure method. The mass flow $MO_2$ is calculated from those values using a second computer program 26.

Based on the actual mass flows $MH_2$ and $MO_2$ and the preset value of stoichiometric flow ratio, $MO_2/MH_2=7.94$, a third computer program 28 defines the controlled variables $SH_2$ and $SO_2$ for slide valves 30 and 32 which are installed in the first and the second supply device, 12 and 14 respectively.

A conduit 34 is provided for tapping little amount of saturated steam from the reaction chamber 10. This is necessary to conduct a subsequent analysis of the stoichiometric combustion ratio: i.e., to determine if neither hydrogen nor oxygen are present as residual gases in the superheated steam. The conduit 34 runs through a pressure-regulating valve (throttle) 36 to a probe 38 adapted for the analysis levels of hydrogen or oxygen in superheated steam. The provision of the pressure-regulating valve 36 is imperative, since the steam tapped from the chamber 10 via the conduit 34 has a pressure greater than 50 bar and a temperature in the range from 500° C. to 2000° C. For the correct operation of the probe 38, however, the pressure of the gas passed therethrough should be about 1 bar and its temperature about 800° C. The valve 36 enables such a pressure reduction through expansion of the superheated steam. It is advantageous that the temperature of the steam is lowered during the expansion to about 800° C., an optimum operating temperature of the probe 38.

The probe 38 generates an electromotoric force corresponding to the excess of oxygen or hydrogen in the superheated steam, and, consequently, produces a measured variable F which is, in turn, dependent on the errors of measurement at the first measuring point 20 and the second measuring point 24. This variable indicates the deviations from a stoichiometric ratio of hydrogen to oxygen.

The measured variable F is entered, via an algorithm established on the basis of an error model, into the third program 28. The variable F entails a correction of the controlled variables $SH_2$ and $SO_2$ calculated by the program 28 and, consequently, a correction of the settings of valves 30 or 32.

Figure 2:
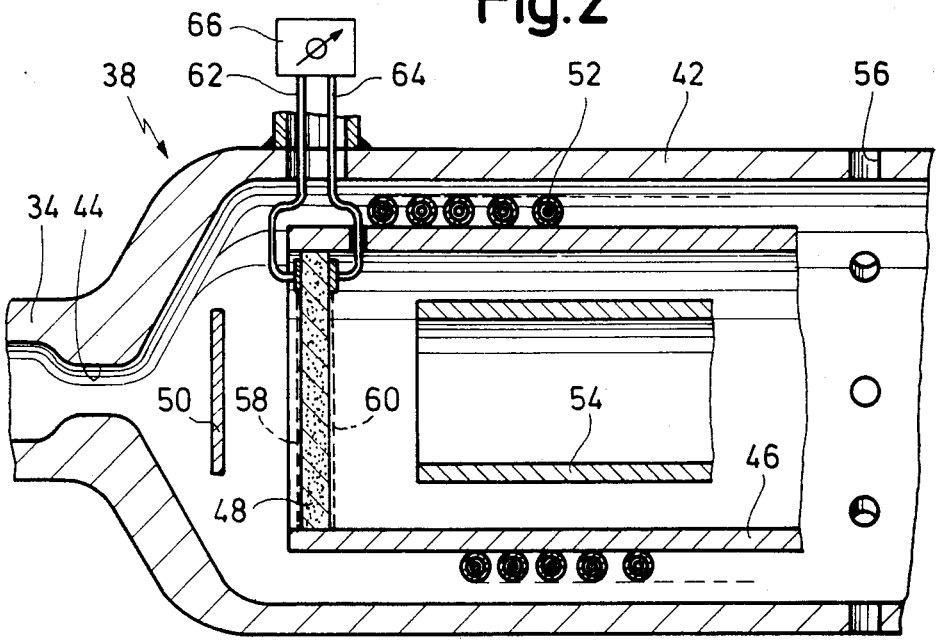
FIG. 2 is a cross-sectional view of a probe used for the control method.

The probe 38 illustrated in FIG. 2 comprises an outer tubular casing 42. To one end of this tubular casing is connected the conduit 34 that supplies the superheated steam, wherein the outlet part of the conduit 34 has a constriction 44 for throttling the stream flow. At the distal end of the tubular casing 42, there are openings 56 in the wall of the casing for carrying off the steam.

Within the tubular casing 42, coaxially thereto, a first tube 46 is disposed. The outer diameter of the tube 46 is smaller than the inner diameter of the tubular casing 42. The tube 46 is closed on its end facing the outlet of the conduit 34 by a ceramic plate 48 made of zirconium oxide. The ceramic plate 48 separates the superheated steam, entering the inside of the casing 42 through the conduit 34, from the interior of the tube 46.

A baffle plate 50 is provided between the ceramic plate 48 and the outlet of the conduit 34, coaxially to the casing 42, to protect the ceramic plate 48 from a direct surge of steam that enters the casing 42.

The first tube 46 is provided on the periphery with a number of heating windings 52 to secure, if necessary, the heating of the ceramic plate 48. The windings 52 enable the heating of the tube 46 and thus, indirectly, of the plate 48 installed therein.

Within the tube 46, is provided coaxially thereto a second tube 54 that enables the ambient air to blow in onto the side of the plate 48 that is turned away from the superheated steam.

The superheated steam that flows through the conduit 34, is throttled in the construction 44 and expands to a pressure of 1 bar in the casing 42; the steam is deflected by the baffle plate 50 to flow along inner walls of the casing 42 and builds up a vortex behind the baffle plate 50 and before the ceramic plate 48, so that the plate 48 is constantly blown against by the steam. Subsequently, the steam flows through the space between the first tube 46 and the inner wall of the casing 42 and escapes from the casing through openings 56.

The ceramic plate 48 maintains its optimal operating temperature range when the temperature of the superheated steam after expansion is about 800° C. If this is not the case, the ceramic plate 48 can be heated by means of the heating windings, or coils 52, up to the operating temperature level.

The side of the plate 48 turned away from the steam is constantly blown against with atmospheric air by means of the second tube 54. Subsequently, the air is carried away through a space between the second tube 54 and an inner wall of the first tube 46.

The ceramic plate 48 of zirconium oxide represents an intrinsic solid electrolyte that generates an electromotoric force (EMF): i.e., a potential difference between the two sides of the plate 48 as a function of the difference between the oxygen/hydrogen concentration in the steam and the oxygen concentration in the atmospheric air.

Both sides of the ceramic plate 48 are provided with a porous platinum layer 58, 60 for the potential difference (voltage) to be tapped. Each layer 58, 60 is connected with an electric conductor 62, 64 which runs to a measuring instrument 66 that is disposed outside the casing 42 and is adapted to determine the electromotoric force.

Figure 3:
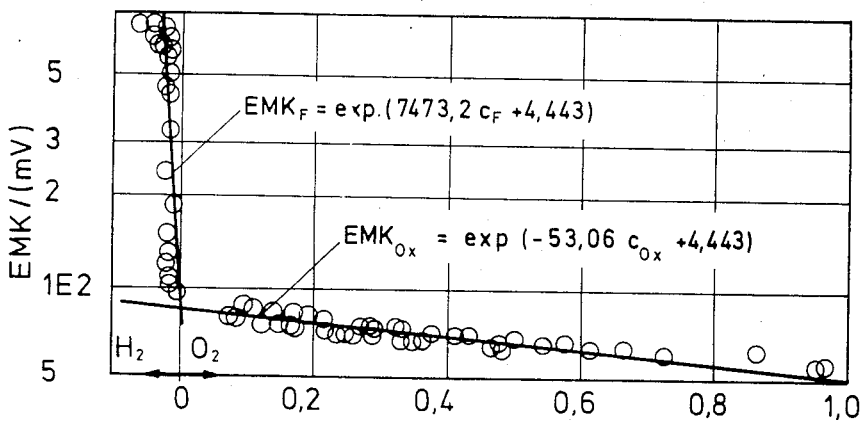
FIG. 3 is a calibration curve of the probe.

FIG. 3 illustrates the relationship between the electromotoric force (EMF), in mV, and the concentration (C) of excess hydrogen ($H_2$) or oxygen ($O_2$). This relationship has been established for superheated steam by means of the probe described above, using a ceramic plate of zirconium oxide. Such a characteristic curve is also dependent on elements that appear alongside oxygen in a gaseous mixture. It can be seen from the logarithmic plotting of the EMF against the respective excess gas concentrations (C) that the EMF increases slowly relative to the decreasing concentration of excess oxygen, but it rises at a steep gradient when the oxygen concentration drops to zero and the concentration of excess hydrogen is rising. The intersection point of these two lines of different gradient represent exactly the stoichiometric point, that is, the point at which both the excess-oxygen concentration and the excess-hydrogen concentration is zero and the superheated steam contains pure water vapor. The sharp change of EMK during the transition from the oxygen excess to the hydrogen excess is helpful to determine the error when the mass flow ratios are measured at the points 20, 24, and thus it enables the combustion process in the reaction chamber to be maintained, in a simple manner, in the stoichiometric range.

The EMK values determined by the measuring instrument 66 are converted to digital form (digitized) in a conventional way in order to be processed by the third program 28. The EMK values are available as errors F for correcting the controlled variables $SH_2$ and $SO_2$ through the third program 28.

For a correct, trouble-free operation of the control method of the invention, it is required that the F value occurred only for a short period of time after the combustion of the mass flows, determined at the first and second measuring points 20, 24, so that the correction of the respective controlled variables $SH_2$ and $SO_2$ can take place as quickly as possible. The time delay between the measurement of the mass flows at the measuring points 20, 26 and the occurrence of F value depends on: (a) a time interval necessary for the gases to flow from the measuring point 20, 24 to the reaction chamber 10, (b) a time interval necessary for the combustion gases to reach the inlet of the conduit 34 into the reaction chamber, (c) a time interval necessary for the combustion gases or superheated steam to flow through the conduit 34 to the ceramic plate 48, and (d) a time interval necessary for the generation of EMK, i.e. a potential difference, in the ceramic plate 48. The time constants of the measuring instrument and the digitizing step associated therewith can be generally disregarded when compared to the above-mentioned time intervals. The total of all the aforesaid time intervals was determined by way of experiment and amounts to about 300–400 milliseconds. Such a time delay is sufficient for the correction of systematic measurement errors generally associated with the differential pressure method, since those errors are essentially dependent on the variations of the variables of state of the gases measured. These variables are subject, as a rule, to fluctuations which have a time constant in the order of minutes.

The embodiments of the invention in which an exclusive right or privilege is claimed are defined as follows:

1. A steam-generator control method for controlling the stoichiometric ratio of the mass flows of an oxidant and a fuel supplied for combustion in accordance with the operating condition, wherein the controlled variables for the mass flow of the oxidant as well as for the mass flow of the fuel are determined through the measurement of both mass flows supplied and through their comparison with theoretically preset stoichiometric ratios, measurement errors are continuously determined, by means of a probe, by a combustion gas analysis conducted after the combustion and the measurement errors are used for the correction of the controlled variables, wherein the correction takes place at a time constant that is shorter than the time constant of the dynamic changes of the errors.

2. A control method according to claim 1, wherein the measurements of the mass flows are conducted in gas phase.

3. A control method according to claim 1 wherein the measurements of the mass flow are conducted by a differential pressure method.

4. A control method according to claim 1, wherein the combustion gases are taken for an analysis by means of a probe at such a point in the steam generator that the variables of state of the gases are suitable for the analysis.

5. A control method according to claim 4, wherein the pressure of the combustion gases before the probe is reduced to a level suitable for the probe.

6. A control method according to claim 1, wherein the analysis of the combustion gases is conducted by means of a solid electrolyte probe.

7. A control method according to claim 6, wherein zirconium oxide ($ZrO_2$) is used as solid electrolyte.

8. A control method according to claim 7, wherein the zirconium-oxide probe is operated using atmospheric air as a reference gas.

9. A control method according to claim 2, wherein the measurements of the mass flow are conducted by a differential pressure method.

10. A control method according to claim 1, wherein the combustion gases are taken for an analysis by means of a probe at such a point in the steam generator that the variables of state of the gases are suitable for the analysis, said method further comprising one or both of the following features:

(a) the measurements of the mass flows are conducted in gas phase, (b) the measurements of the mass flow are conducted by a differential pressure method.

11. A control method according to claim 10, wherein the pressure of the combustion gases before the probe is reduced to a level suitable for the probe.

12. A control method according to claim 1, wherein the analysis of the combustion gases is conducted by means of a solid electrolyte probe, said method further comprising one or more of the following features:

(a) the measurements of the mass flows are conducted in gas phase, (b) the measurements of the mass flow are conducted by a differential pressure method, (c) the combustion gases are taken for an analysis by means of a probe at such a point in the steam generator that the variables of state of the gases are suitable for the analysis, (d) the pressure of the combustion gases before the probe is reduced to a level suitable for the probe.

13. A control method according to claim 12, wherein zirconium oxide ($ZrO_2$) is used as the solid electrolyte probe.

14. A control method according to claim 13, wherein the zirconium oxide probe is operated using atmospheric air as a reference gas.

* * * * *